US008754539B2

(12) United States Patent
Black et al.

(10) Patent No.: US 8,754,539 B2
(45) Date of Patent: Jun. 17, 2014

(54) TRAFFIC POWERED RENEWABLE ENERGY SYSTEM

(75) Inventors: Ralph A. Black, Hanover Park, IL (US); Asad Ali, Palatine, IL (US)

(73) Assignee: RBAA and Associates, Inc., Hanover Park, IL (US)

( * ) Notice: Subject to any disclaimer, the term of this patent is extended or adjusted under 35 U.S.C. 154(b) by 60 days.

(21) Appl. No.: 13/542,313

(22) Filed: Jul. 5, 2012

(65) Prior Publication Data

US 2013/0011277 A1 Jan. 10, 2013

Related U.S. Application Data

(60) Provisional application No. 61/504,914, filed on Jul. 6, 2011.

(51) Int. Cl.
*F02B 63/04* (2006.01)

(52) U.S. Cl.
USPC ..... 290/1 R

(58) Field of Classification Search
USPC ..... 290/1 R
See application file for complete search history.

(56) References Cited

U.S. PATENT DOCUMENTS

| | | | | |
|---|---|---|---|---|
| 4,212,598 | A * | 7/1980 | Roche et al. | 417/229 |
| 4,339,920 | A * | 7/1982 | Le Van | 60/533 |
| 4,409,489 | A | 10/1983 | Hayes | |
| 4,614,875 | A | 9/1986 | McGee | |
| 6,204,568 | B1 * | 3/2001 | Runner | 290/1 R |
| 6,949,840 | B2 | 9/2005 | Ricketts | |
| 7,145,257 | B2 * | 12/2006 | Ricketts | 290/1 R |
| 7,432,607 | B2 * | 10/2008 | Kim et al. | 290/1 R |
| 7,541,684 | B1 | 6/2009 | Valentino | |
| 8,232,661 | B2 * | 7/2012 | Cannarella | 290/1 R |
| 8,330,283 | B2 * | 12/2012 | Lin | 290/1 R |
| 2003/0034652 | A1 | 2/2003 | Slatkin | |
| 2007/0264081 | A1 * | 11/2007 | Chiu | 404/71 |
| 2008/0157537 | A1 * | 7/2008 | Richard | 290/1 R |

* cited by examiner

*Primary Examiner* — Tho D Ta
(74) *Attorney, Agent, or Firm* — Jason L. Gilbert

(57) ABSTRACT

A traffic powered renewable energy system for generating electricity from traffic on roadways and the like. The traffic powered renewable energy system generally includes a housing containing one or more pneumatic compression assemblies positioned therein and connected in series utilizing air conveying conduits. The housing is positioned within a cavity in a roadway and covered with a membrane. As vehicles pass over the membrane, the pneumatic compression assemblies are actuated in a piston-like manner to force air through the air conveying conduits to a generation assembly which includes a turbine, gear box and generator for producing electricity.

14 Claims, 6 Drawing Sheets

TRAFFIC POWERED RENEWABLE ENERGY SYSTEM

CROSS REFERENCE TO RELATED APPLICATIONS

I hereby claim benefit under Title 35, United States Code, Section 119(e) of U.S. provisional patent application Ser. No. 61/504,914 filed Jul. 6, 2011. The 61/504,914 application is currently pending. The 61/504,914 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a renewable energy system and more specifically it relates to a traffic powered renewable energy system for generating electricity from traffic on roadways and the like.

2. Description of the Related Art

Any discussion of the related art throughout the specification should in no way be considered as an admission that such related art is widely known or forms part of common general knowledge in the field.

With the rising economic and environmental impact of fossil fuel based energy, there has been a heightened interest in recent years in renewable energy sources. Such energy sources generally include solar power, wind power and the like. However, these sources of renewable energy suffer from a number of shortcomings. For example, solar power is entirely dependent on constant UV exposure and thus is not capable of 24-hour functioning. Similarly, wind power depends on favorable wind conditions for power generation.

While such systems have been in use for years with some success, it would be preferable to provide a renewable energy source which is capable of generating electricity at all hours of the day or night and without dependency on unpredictable weather elements. Such a system would allow for more efficient and consistent generation of power.

Because of the inherent problems with the related art, there is a need for a new and improved traffic powered renewable energy system for generating electricity from traffic on roadways and the like.

BRIEF SUMMARY OF THE INVENTION

The invention generally relates to a renewal energy system which includes a housing containing one or more pneumatic compression assemblies positioned therein and connected in series utilizing air conveying conduits. The housing is positioned within a cavity in a roadway and covered with a membrane. As vehicles pass over the membrane, the pneumatic compression assemblies are actuated in a piston-like manner to force air through the air conveying conduits to a generation assembly which includes a turbine, gear box and generator for producing electricity.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
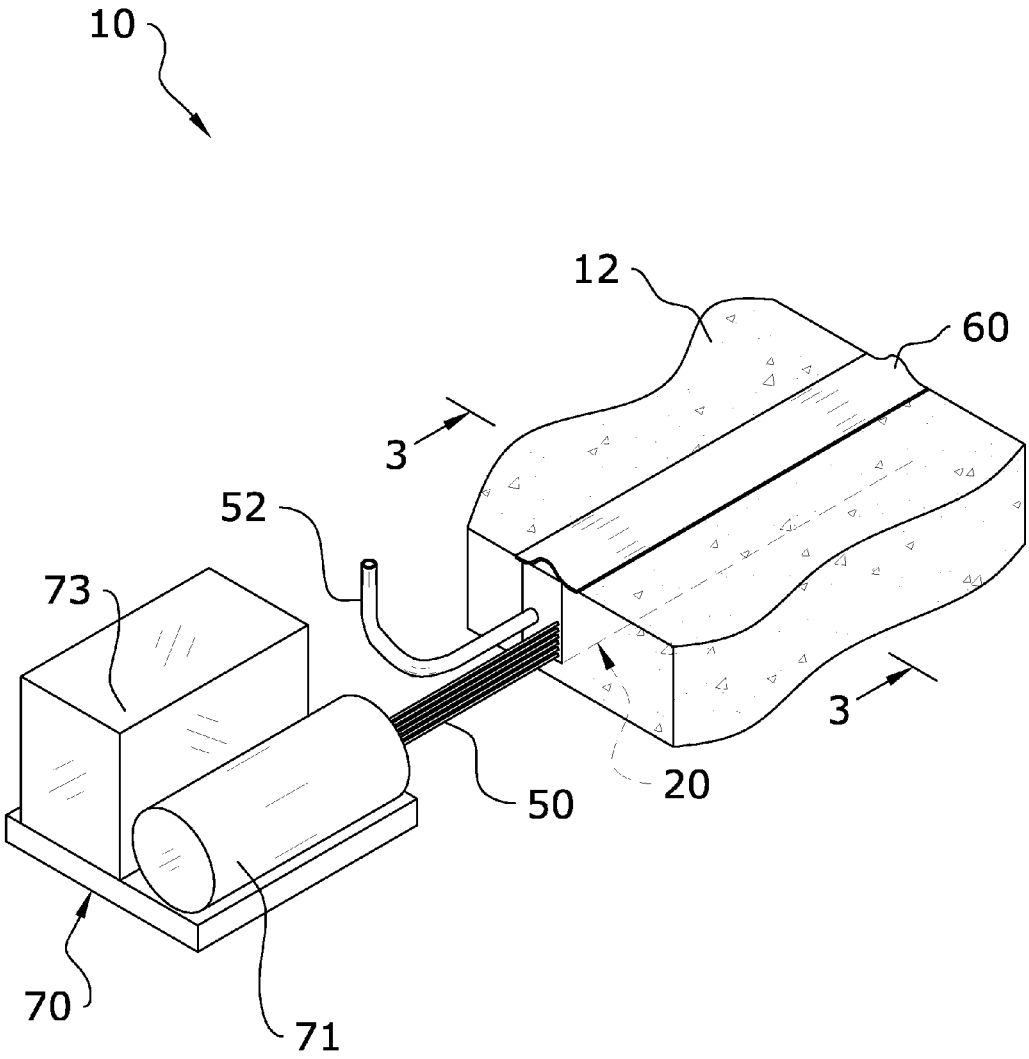
FIG. 1 is an upper perspective view of the present invention.

A. Overview.

Turning now descriptively to the drawings, in which similar reference characters denote similar elements throughout the several views, FIGS. 1 through 6 illustrate a traffic powered renewable energy system 10, which comprises a housing 20 containing one or more pneumatic compression assemblies 30 positioned therein and connected to an air compression tank 71 utilizing air conveying conduits 50. The housing 20 is positioned within a cavity in a roadway 12 and covered with a membrane 60. As vehicles pass over the membrane 60, the pneumatic compression assemblies 30 are actuated in a piston-like manner to force air through the air conveying conduits 50 to a generation assembly 70 which includes a turbine 74, gear box 75 and generator 76 for producing electricity.

B. Housing.

Figure 2:
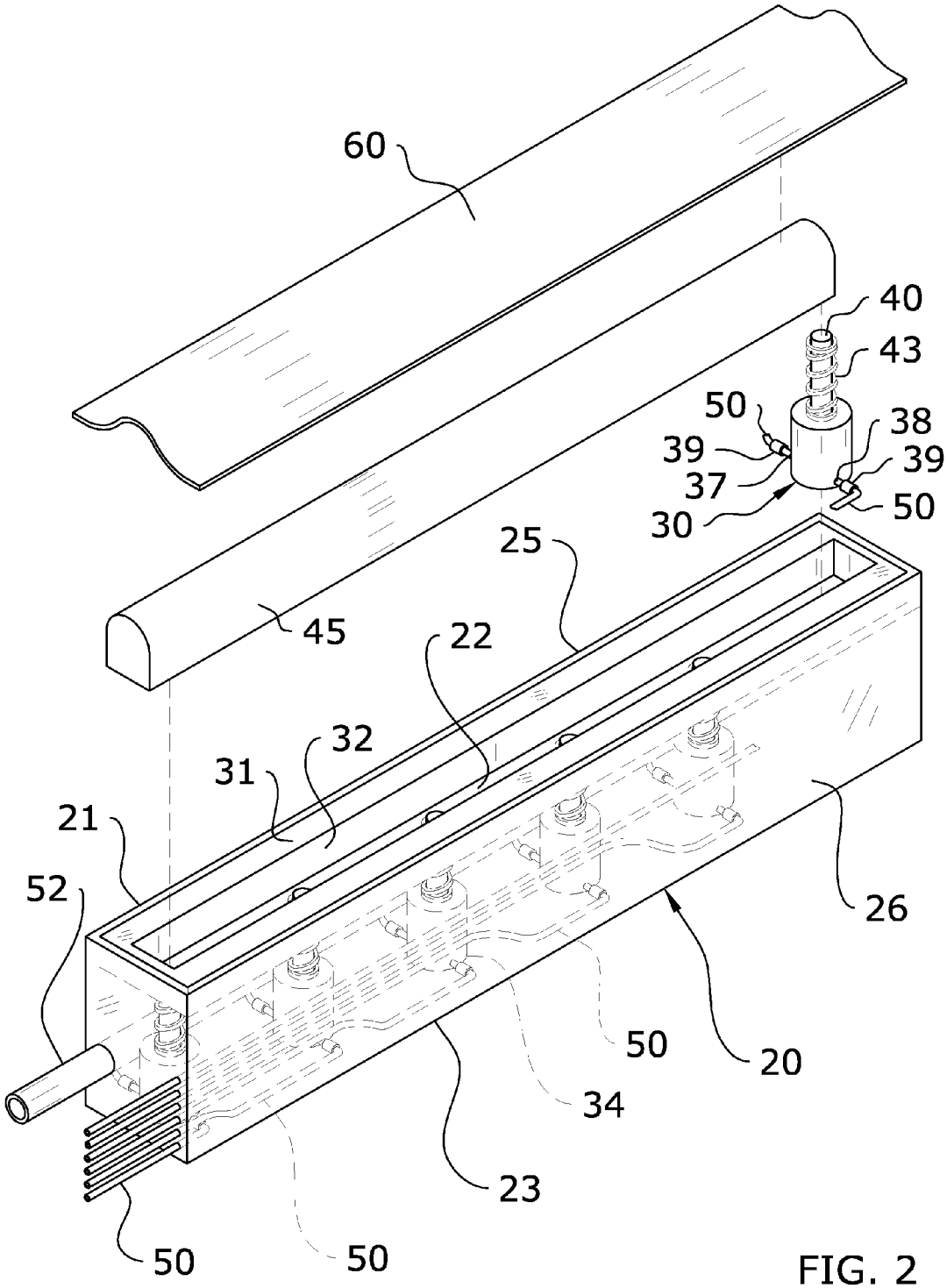
FIG. 2 is an upper perspective exploded interior view of the present invention.

As best shown in FIG. 2, the present invention generally includes a housing 20 which stores the one or more pneumatic compression assemblies 30 of the present invention at a position just underneath the roadway 12. The housing 20 may be comprised of various shapes and sizes, and thus should not be construed as being limited to the rectangular shape shown in the figures. For example, a cylindrical housing 20 could be used in various embodiments. Further, other embodiments may have a larger width so as to accommodate two-deep installations of pneumatic compression assemblies 30 (i.e. two assemblies 30 per column).

The housing 20 includes an upper end 21 and a lower end 23. The upper end 21 of the housing 20 includes an upper opening 22 through which the cap members 45 of each pneumatic compression assembly 30 will extend when the present invention is in use. The housing 20 also includes a pair of sidewalls 25, 26 which protect the various internal components of the present invention from damage caused by exposure to dirt or other elements.

The housing 20 of the present invention is generally installed in cavity formed in a roadway 12 as shown in FIG. 1. The upper end 21 of the housing 20 will generally be flush or substantially flush with the surface of the roadway 12 to ensure that the pneumatic compression assemblies 30 are activated when a vehicle passes thereover. The housing 20 may also include one or more openings along its outer surface through which an air conveying conduit 50 may exit the housing 20 to link the pneumatic compression assemblies 30 with the generation assembly 70.

C. Pneumatic Compression Assembly.

The present invention includes one or more pneumatic compression assemblies 30 as shown throughout the figures. Each of the pneumatic compression assemblies 30 is adapted to force air through an air conveying conduit 50 in response to piston action caused by vehicles passing over the housing 20 on the roadway 12.

Figure 3:
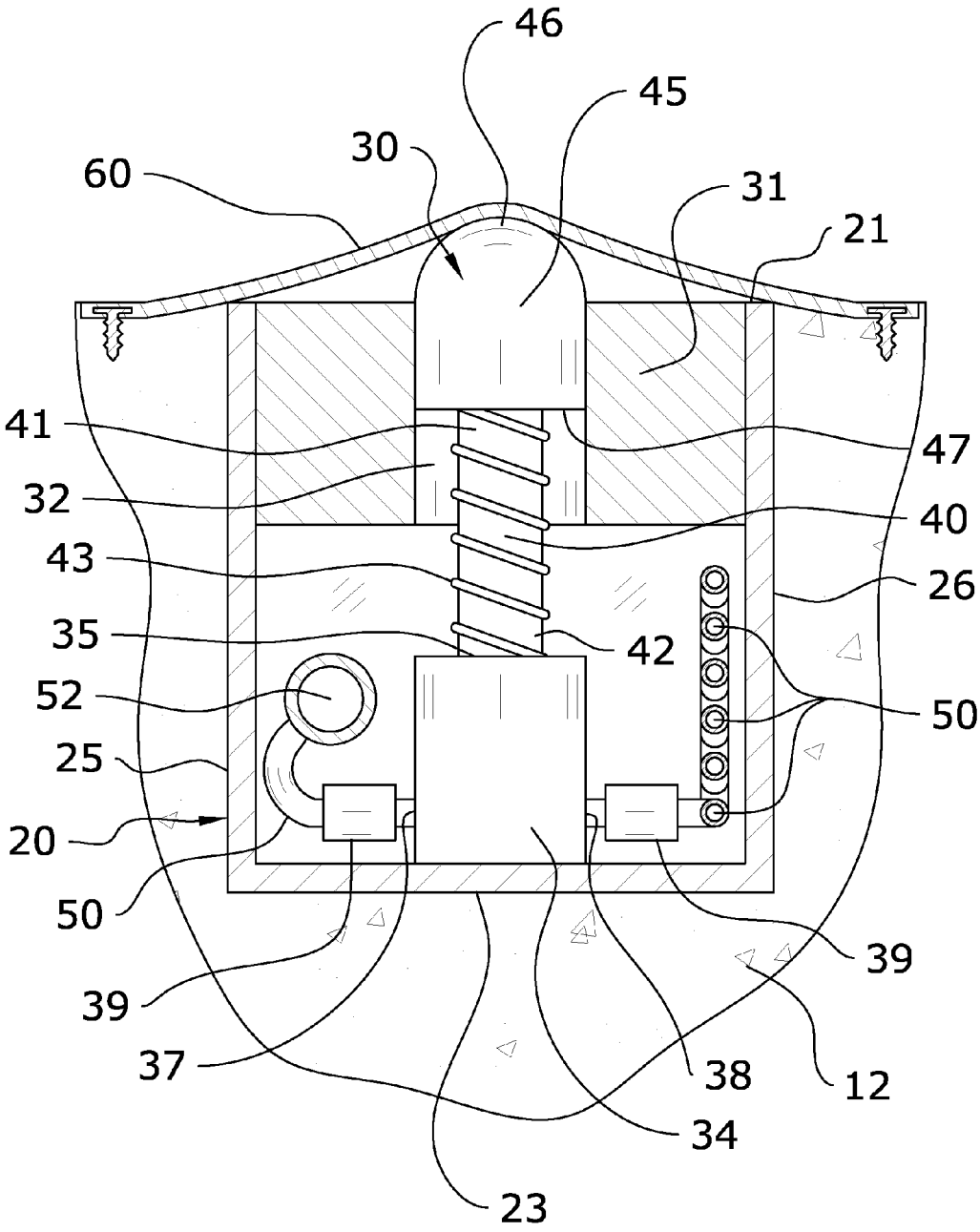
FIG. 3 is a side sectional view of the present invention taken along line 3-3 of FIG. 1.
Figure 4:
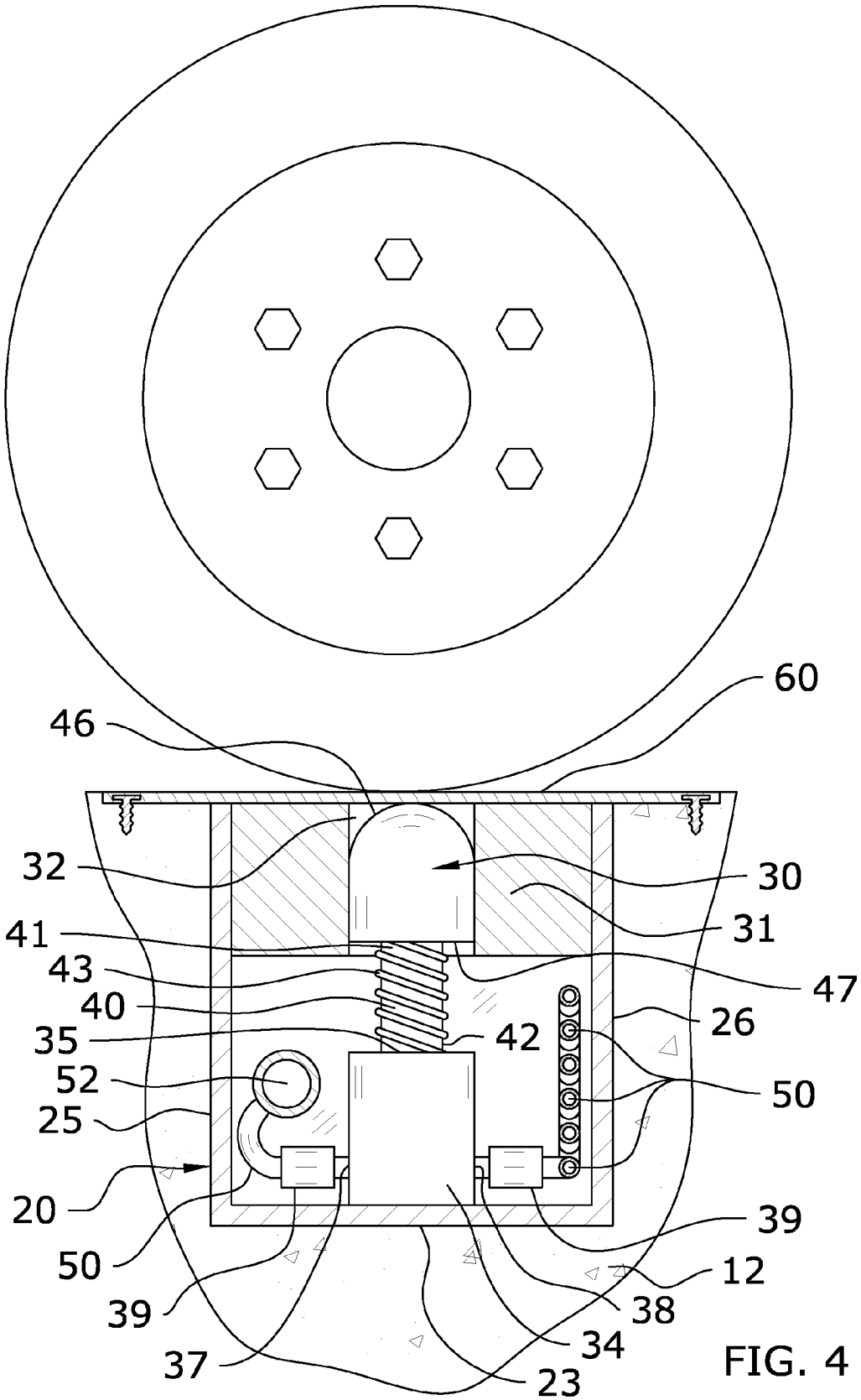
FIG. 4 is a side sectional view of the pneumatic compression assembly of the present invention in use.

As best shown in FIG. 3, each pneumatic compression assembly 30 is comprised of a compression chamber 34, an activation cylinder 40 extending from the compression chamber 34 and a cap member 45. The compression chamber 34 is comprised of an enclosed and sealed box-like structure with a volume of air therein which will be forced out of the compression chamber 34 and into an air conveying conduit 50 after activation of the activation cylinder 40.

The compression chamber 34 generally includes an upper opening 35, an inlet 37 and an outlet 38. The activation cylinder 40 of the present invention extends out through the upper opening 35. The inlet 37 of each compression chamber 34 is connected through a check valve 39 to an air intake manifold 52. The outlet 38 of each compression chamber 34 is connected through a check valve 39 to an air conveying conduit 50. The air conveying conduit 50 will transfer expelled air into a compression chamber 71 for use in power generation. Each cylinder 40 has its own air conveying conduit 50 and the air conveying conduits 50 traverse through and out of the housing 20 in a vertically oriented manner as shown in the figures.

The air intake manifold 52 is comprised of a conduit or other structure which extends along the length of the interior of the housing 20 alongside the compression assemblies 30. The air intake manifold 52 exits the housing and terminates above-grade in a location with ambient air, which is pulled into the compression chambers 34 on the up-motion of the cylinders 40.

The activation cylinder 40 is comprised of a piston-like structure which extends out of the upper opening 35 of the compression chamber 34 as shown in FIG. 3. The activation cylinder 40 has an upper end 41 which is secured to the lower end 47 of the cap member 45 of the present invention and a lower end 42 which is movably secured within the upper opening 35 of the compression chamber 34.

The activation cylinder 40 preferably includes a bias member 43 as shown in FIG. 3 for ensuring that the activation cylinder 40 reverts to its extended position naturally after being compressed by the weight of a vehicle passing thereover. Various types of bias members 43 may be utilized, and thus the scope of the present invention should not be construed as being limited by the exemplary illustrations showing usage of a coil spring (a preferred embodiment).

The cap member 45 is generally positioned within a sleeve 31 as shown in FIG. 2. The sleeve 31 of the present invention is generally comprised of a rectangular structure having a central slot 32 extending therethrough. The sleeve 31 generally is approximately the same length as the housing 20.

The sleeve 31 is utilized to ensure that the activation cylinder 40 moves only vertically without any side-to-side movement. Thus, the width of the sleeve 31 will preferably be only slightly smaller than the distance between the first and second sidewalls 25, 26 of the housing 20. The sides of the sleeve 31 should abut against and/or frictionally engage with the interior sidewalls 25, 26 of the housing 20 to prevent any non-vertical movement.

The cap member 45 of the present invention is positioned within the slot 32 of the sleeve 31 as shown in FIG. 2 so as to come into contact with the upper end 41 of each of the cylinders 40. The cap member 45 itself includes an upper end 46 which extends slightly out of the upper end 21 of the housing 20. The lower end 47 of the cap member 45 is secured to the upper end 41 of the activation cylinder 41. The cap member 45 will preferably be comprised of a structure, configuration and material which will endure repeated contact from vehicles passing thereover without becoming damaged or compromised. The cap member 45 will preferably be comprised of a dome-shaped design, but other configurations may be utilized in different embodiments.

D. Conduit and Membrane.

As shown in the figures, air conveying conduit 50 is used to link the pneumatic compression assemblies 30 to the compression tank 71. Various types of conduits 50 known in the art to transfer air (forced, compressed or ambient) may be utilized.

The present invention also utilizes a membrane 60 which is positioned on the roadway 12 so as to cover and abut against the upper end 46 of the cap members 45. Various types of membranes 60 may be utilized, so long as the material is capable of being constantly exposed to vehicle traffic and various weather elements without becoming prematurely warped or damaged.

E. Generation Assembly.

Figure 5:
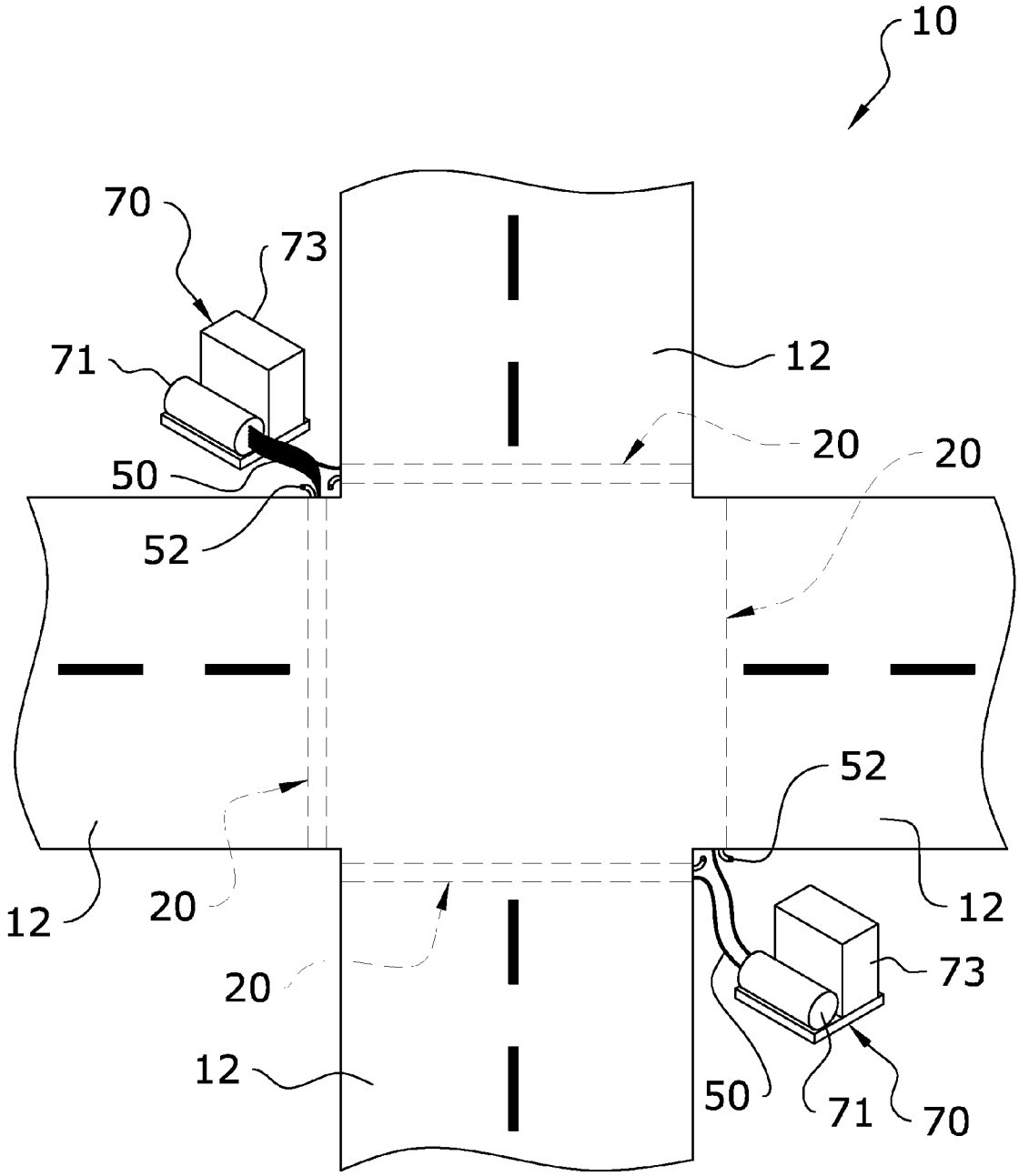
FIG. 5 is a top view of an exemplary installation of the present invention at a four-way intersection.

Air which is forced through the conduits 50 via piston action of the pneumatic compression assemblies 30 is fed into a generation assembly 70. The generation assembly 70 may be positioned underground with the pneumatic compression assembly 30 or may be positioned above-grade at a corner of an intersection as shown in FIG. 5.

Figure 6:
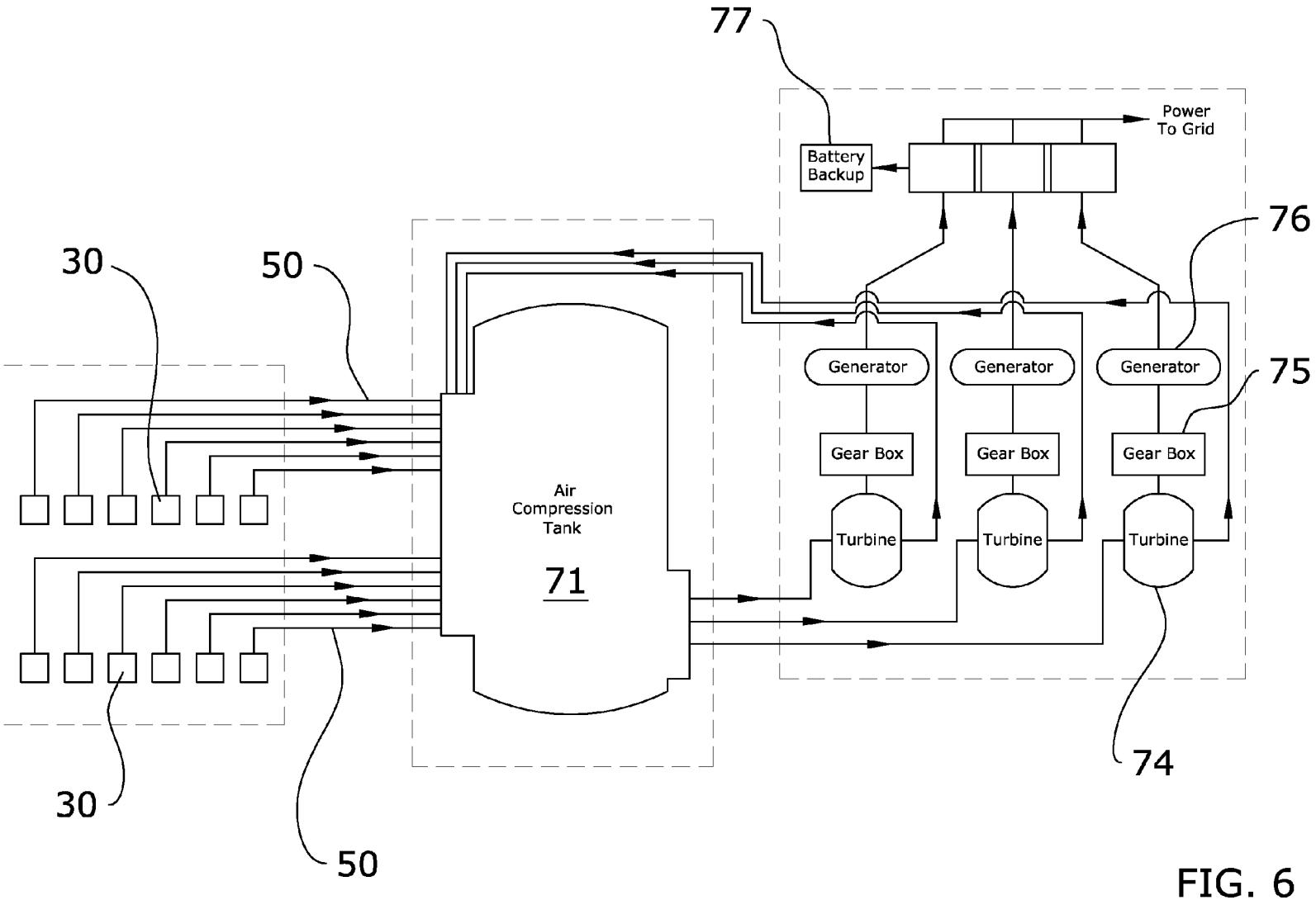
FIG. 6 is a block diagram illustrating interconnection of components of one embodiment of the present invention.

Each generation assembly 70 generally includes an air compression tank 71 and a housing 73 which stores the turbine 74, gear box 75 and generator 76 of the present invention. The air compression tank 71 may be utilized to store collected air under pressure until it is fed to the generator 76 to produce electricity. The produced energy may be transferred to the electrical grid, or utilized for other purposes such as powering nearby traffic lights, buildings, toll booths, businesses and/or other buildings. In case of power outage, an auxiliary battery backup 77 may be provided as shown in FIG. 6 to power traffic lights and/or other accessories in times of power failure.

F. Operation of Preferred Embodiment.

In use, a cavity is formed in a roadway 12 and the housing 20 of the present invention placed therein. It is appreciated that one or more units of the present invention may be installed per lane, depending on the traffic levels in that area as well as the powering needs. The generation assembly 70 is also installed and connected to the housing 20 via an air conveying conduit 50. As vehicles pass over the housing 20, the activation cylinders 40 will undergo piston-type action to force air through the air conveying conduit 50 to the generation assembly 70 to produce electricity.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A traffic powered renewable energy system, comprising:

a housing adapted to be positioned within a cavity underneath a roadway, wherein said housing includes an upper end, a first sidewall, and a second sidewall, wherein said upper end of said housing includes an elongated upper opening, said elongated upper opening extending along a length of said housing;

a sleeve positioned within said elongated upper opening of said housing, wherein a first side of said sleeve abuts against said first sidewall and a second side of said sleeve abuts against said second sidewall;

a slot extending along a length of said sleeve;

a plurality of pneumatic compression assemblies positioned within said housing, wherein said pneumatic compression assemblies com rise a plurality of compression chambers and a plurality of activation cylinders;

a cap member movably positioned within said slot to seal an interior of said housing;

wherein an upper end of each of said activation cylinders is connected to a lower end of said cap member; and a generation assembly connected to said pneumatic compression assemblies via one or more air conveying conduits.

2. The traffic powered renewable energy system of claim 1, wherein said housing is comprised of a rectangular configuration.

3. The traffic powered renewable energy system of claim 1, wherein a lower end of each of said activation cylinders is movably secured within an upper opening of one of said compression chambers.

4. The traffic powered renewable energy system of claim 1, wherein said generation assembly is comprised of a housing, a turbine, a gear box and a generator.

5. The traffic powered renewable energy system of claim 4, wherein said generation assembly is further comprised of an air compression tank.

6. A traffic powered renewable energy system, comprising:

a housing positioned underneath a roadway;

a plurality of pneumatic compression assemblies positioned within said housing, wherein each of said pneumatic compression assemblies is comprised of a compression chamber and an activation cylinder slidably and sealably positioned within an upper opening of said compression chamber;

a sleeve positioned within an upper opening of said housing, wherein a first side of said sleeve abuts against a first sidewall of said housing and a second side of said sleeve abuts against a second sidewall of said housing;

a slot extending along a length of said sleeve;

a cap member connected to an upper end of said pneumatic compression assemblies, wherein said cap member is sealably and movably positioned within said slot;

a flexible membrane covering said cap member, wherein a first side of said flexible membrane is secured to said roadway adjacent a first side of said housing and a second side of said flexible membrane is secured to said roadway adjacent a second side of said housing; and a generation assembly connected to said pneumatic compression assemblies via a plurality of air conveying conduits, wherein said plurality of air conveying conduits are vertically-oriented along said second sidewall of said housing.

7. The traffic powered renewable energy system of claim 6, wherein said compression chamber includes an inlet and an outlet.

8. The traffic powered renewable energy system of claim 7, wherein said inlet is connected to an air intake manifold.

9. The traffic powered renewable energy system of claim 8, wherein said air intake manifold is positioned within said housing alongside said pneumatic compression assemblies.

10. The traffic powered renewable energy system of claim 9, wherein said outlet is connected to said generation assembly via an air conveying conduit.

11. The traffic powered renewable energy system of claim 10, wherein said generation assembly includes an air compression tank, wherein said outlet is connected to said air compression tank via said air conveying conduit.

12. The traffic powered renewable energy system of claim 11, wherein said generation assembly is further comprised of a housing, a turbine, a gear box and a generator.

13. The traffic powered renewable energy system of claim 12, wherein said activation cylinder includes an upper end and a lower end, wherein said lower end of said activation cylinder is movably and sealably secured within said upper opening of said compression chamber.

14. The traffic powered renewable energy system of claim 13, wherein said upper end of said activation cylinder is secured to said cap member.

* * * * *